US006531949B2

(12) United States Patent
Endo et al.

(10) Patent No.: US 6,531,949 B2
(45) Date of Patent: Mar. 11, 2003

(54) FUSE

(75) Inventors: Takayoshi Endo, Shizuoka (JP); Hiroki Kondo, Shizuoka (JP); Norihiro Ohashi, Shizuoka (JP); Takahiro Sato, Shizuoka (JP); Goro Nakamura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/801,895

(22) Filed: Mar. 9, 2001

(65) Prior Publication Data

US 2001/0024155 A1 Sep. 27, 2001

(30) Foreign Application Priority Data

Mar. 22, 2000 (JP) ..... 2000-079226

(51) Int. Cl.[7] ..... H01H 85/02; H01H 85/143

(52) U.S. Cl. ..... 337/260; 337/142; 337/186; 337/227; 337/295

(58) Field of Search ..... 361/251, 255, 361/260, 264, 295; 337/142, 186, 227; 439/621, 622

(56) References Cited

U.S. PATENT DOCUMENTS 4,580,124 A 4/1986 Borzoni
4,661,793 A 4/1987 Borzoni
4,672,352 A * 6/1987 Takano ..... 337/260
5,294,906 A * 3/1994 Totsuka et al. ..... 337/260
5,886,612 A * 3/1999 Beckert et al. ..... 337/186

* cited by examiner

*Primary Examiner*—Jayprakash N. Gandhi
(74) *Attorney, Agent, or Firm*—Armstrong, Westerman & Hattori, LLP

(57) ABSTRACT

A fuse 1 includes a pair of terminals 2, housing 4 and a fusible body 5. The one ends 3*a* of the terminals are housed in a housing chamber 20 of the housing 4. The housing 4 has a first inner wall 12*a*, a second inner wall 12*b*, a first partition wall 21 and second partition walls 22. The end face 8 of the one end 3*a* of each of the terminals 2 is located apart from the inner face 12*a* of the first end wall 21. The fusible body 5 couples the terminals with each other. Both ends of the fusible body 5 are mechanically connected to the end faces 8. The first partition wall 21 extends from the inner face 15*a* of the first end wall 12*a* toward the inner face 15*b* of the second inner wall 12*b*. The second partition walls 22 extend from the inner face 15*b* of the second inner wall 12*b* toward the inner face 15*a* of the first inner wall 12*a*. In accordance with the fuse having this configuration, when the fuse is supplied with supplied with power with a current exceeding a prescribed value the fusible body fuses, supply of the power to a load can be surely stopped.

5 Claims, 4 Drawing Sheets

FUSE

BACKGROUND OF THE INVENTION

1. Field of the Invention

This invention relates to fuse.

2. Description of the Related Art

A motor vehicle which is a moving body includes a large number of power transmission lines for transmitting power itself and various signals, such as bas bars in electric connection boxes (junction block, relay box, fuse block, etc.), terminals for connectors for electric connection.

The main tendency of the voltage of the power transmitted along the power transmission line is 14 V for a general passenger car, and 28 V (14×2) for a large scale vehicle such as a bus or truck (both in terms of an effective voltage). However, particularly for the passenger car, it has been proposed to adopt a power system for supplying an electric power with a higher voltage value than before in view of demands of improvement in driving efficiency of loads and driving with at an optimum efficiency for each load.

The above power transmission line includes fuse blocks from which a large number of fuses can be removed in order to protect electric circuits for various electric appliances (since the fuse block may have a relay or bus bar, it is referred to as a relay box or junction block, or generally referred to as "electric connection box". In this specification, the above fuse block, relay box, junction block are generally referred to as "electric connection block.

The fuse which has been conventionally used for the electric connection block is such a fuse 51 as shown in FIG. 6. The fuse 51 includes a pair of terminals 52 arranged in parallel, a housing 54 which houses one ends 53 of these terminals 52 and a fusible body 55 which is formed integrally to the pair of terminals 52 and connect them to each other.

When the fuse 51 is mounted in the electric connection box, the terminals 52 are electrically connected to receiving terminals of the box, respectively. One of the receiving terminals is supplied with an electric power whereas the other thereof is electrically connected to various loads. Thus, the one of the terminal 52 is supplied with the electric power through the receiving terminal whereas the other thereof is connected to the loads. The terminals 52 are housed within the housing 54 in a state where their inner faces 61 are opposite to each other.

The housing 54 is made of insulating synthetic resin. The housing 54 is formed in a box shape. The interior of the housing 54 constitutes a housing chamber within which the one ends of the above pair of terminals 52 are housed.

As shown in FIGS. 6 and 7, the fusible body 55 connects the one ends 53 of the terminals 52 to each other. The fusible body 55 is coupled at its both ends with the inner faces 61 which are located at the one ends 53 of the terminals 52. The fusible body 55 includes a fusing portion 62 which fuses when the current value of the electric power supplied from the one of the terminals 52 exceeds a prescribed current value. The fusible portion 62 is formed to have a small sectional are a of the fusible body 55.

Where the fuse 51 thus configured is mounted on the electric connecting box, when the current value of the electric power supplied from the one of the terminals 52 through the one receiving terminal exceeds the prescribed current value, the fusing portion 62 of the fusible portion 55 fuses to stop supply of the electric power to the load.

In the fuse 51 shown in FIG. 6, since the fusible 55 is coupled with the opposite inner faces of the terminals 52, there is a relatively small space 60 (FIGS. 6 and 8) in which the fused potion 62 of the fusible body 55 formed between the inner faces 61 within the housing chamber can scatter. Further, it is generally known that the fusing portion 62 of the fusible body 55 scatters higher momentum as the current value in fusing increases.

In the above conventional fuse 51, when the fusing potion 62 of the fusible body 55 fuses with a higher current value than before, it scatters with higher momentum. The fused fusible body 55 might short-circuits the terminals to each other within the space 60.

This means difficulty of assuring the insulation between the terminals 52. In this case, supply of the electric power to the load which should be stopped may continue, and therefore the electric power with an excessive current value may be supplied to the load.

An object of this invention is to provide a fuse which can surely stop supply of an electric power to a load when the electric power with the current which exceeds a current value of fusing a fusible body is supplied.

In order to attain the above object, in accordance with this invention, there is provided a fuse including a pair of terminals arranged in parallel, a housing having a housing chamber for housing respective one ends thereof and a fusible body for coupling the pair of terminals with each other, wherein the fusible body is connected to respective end faces of the one ends of the pair of terminals.

In this configuration, since the fusible body is connected to the respective end faces of the one ends of the pair of terminals, the fusible body can be lengthened, and the distance between the connecting positions at the pair of terminals can be increased. For this reason, the fused fusible body is difficult to remain the pair of terminals. Therefore, after the fusible body has fused, the fuse surely prevents the pair of the terminals from being communicated with each other. Thus, when the power with a current value which exceeds the fusing current value of the fusible body is supplied, supply of the power to the load can be surely stopped.

Preferably, the housing comprises a first inner wall which is opposite to the respective end faces of the pair of terminals and constitutes the housing chamber, and the pair of terminals are arranged in a state where the end faces of their one ends are apart from the inner wall.

In this configuration, since the above end faces are apart from the first inner wall, the space where the fusible body can scatter in the housing chamber can be increased. Therefore, deposition of the fused fusible body on the surfaces of the terminals can be suppressed so that the fused fusible body is difficult to remain the pair of terminals. Accordingly, after the fusible body has fused, the same effect as described above can be obtained.

Preferably, the housing the housing further comprises:

a second inner wall opposite to the first inner wall;

a first partition wall which extends from the first inner wall toward the the second inner wall and is located between the plurality of terminals in a direction they are arranged in parallel; and a plurality of second partition walls which extend from the second inner wall toward the first inner wall and are located between the first partition wall and the pair of terminals, respectively.

In this configuration, since the first partition wall and second partition walls are located between the pair of terminals, the fused fusible body is more difficult to remain the pair of terminals. Accordingly, after the fusible body has fused, the same effect as described above can be obtained.

Preferably, the fusible body is bent to include

- a pair of first extending segments which extend from the pair of terminals in a direction leaving therefrom, respectively;
- a pair of second extending segments which extend from ends of the first extending segments in a direction the pair of terminals approach each other;
- a pair of third extending segments which extend from ends of the second extending elements in a direction approaching the pair of terminals; and
- a coupling segment which couples the pair of third extending segments.

In this configuration, since the fusible body is bent to include the first to the third extending segment and coupling segment, the fusible body can be lengthened. Therefore, the fused fusible body is more difficult to remain the pair of terminals. Accordingly, after the fusible body has fused, the same effect as described above can be obtained.

Preferably, the first pair of and third pair of extending segments are formed along the first partition wall, and the second pair of extending segments and the coupling segment are formed along the first inner wall. In this configuration, since the fused fusible body is apt to be deposited on the first and second partition walls and the first inner wall, the fused fusible body is more difficult to remain the pair of terminals. Accordingly, after the fusible body has fused, the same effect as described above can be obtained.

The above and other objects and features of the invention will be more apparent from the following description taken in conjunction with the accompanying drawings.

DESCRIPTION OF THE PREFERRED EMBODIMENTS

Figure 2:
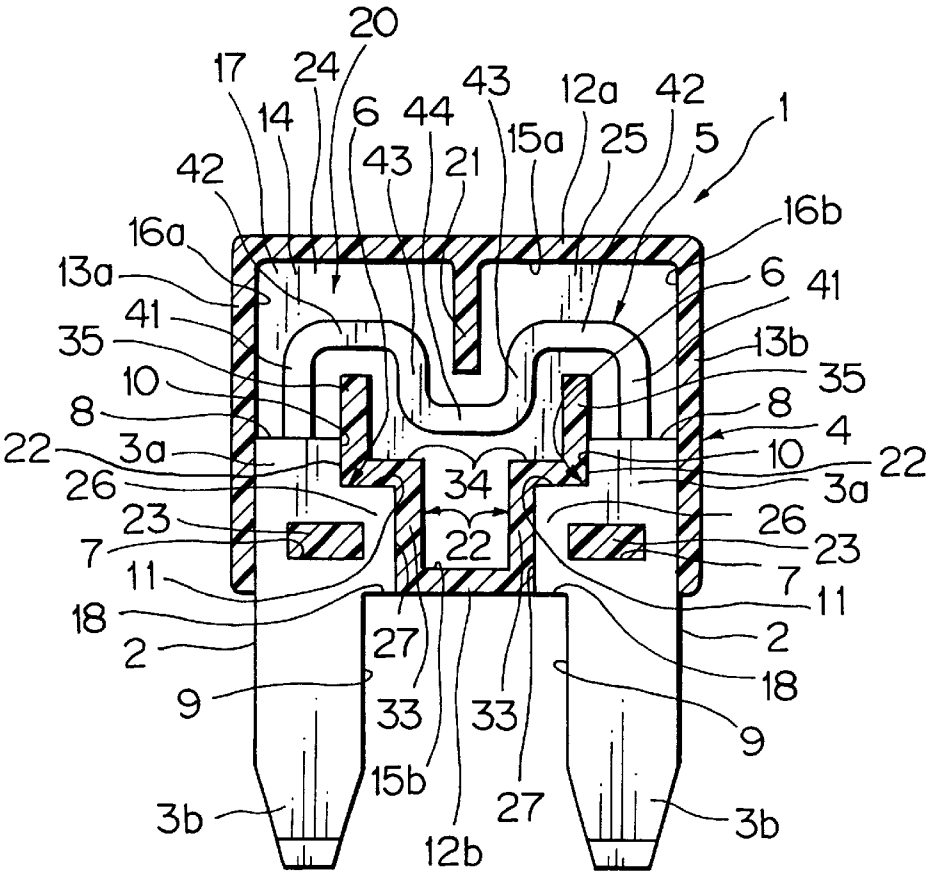
FIG. 2 is a sectional view taken in line II—II in FIG. 1.
Figure 1:
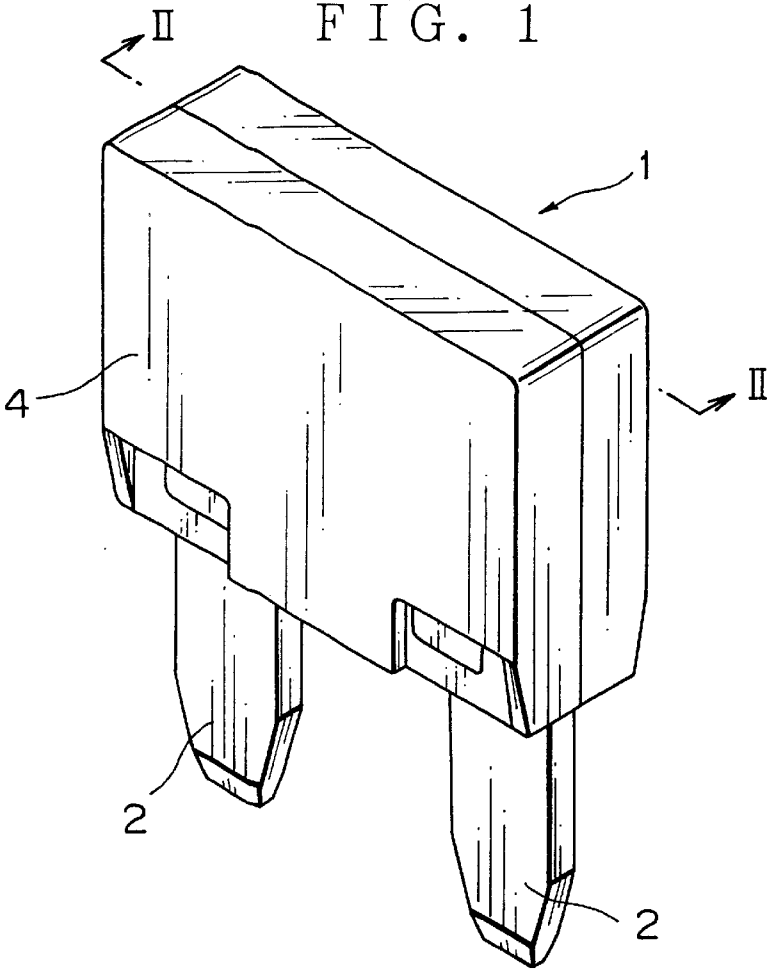
FIG. 1 is a perspective view of a fuse according to a first embodiment of this invention.

Now referring to FIGS. 1 to 4, an explanation will be given of the fuse according to the first embodiment of this invention. As seen from FIGS. 1 and 2, a fuse 1 includes a pair of terminals 2 arranged in parallel to each other, a housing 4 which houses the one ends 3*a* of these terminals and a fusible body 5 which connects the terminals 2 to each other.

The terminal 2 is made of a conductive material, respectively. The terminal 2 is formed in a plate shape. The terminal 2 is provided so that its one end 3*a* is housed within the housing 4 and its other end 3*b* is exposed outside the housing 4. The terminal 2 has a recess 6 and an attaching hole 7.

Figure 3A:
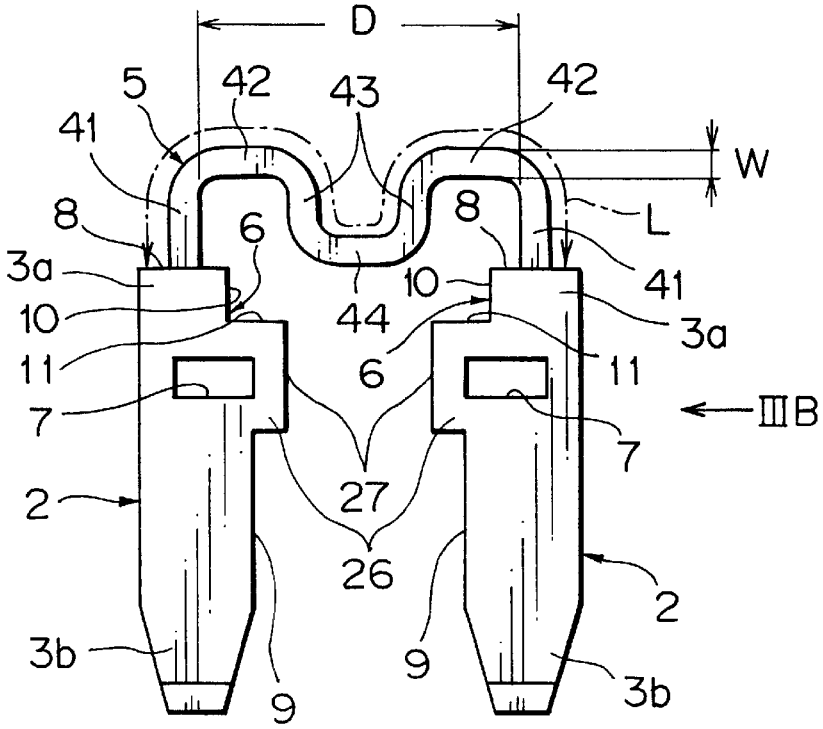
FIG. 3A is a sectional view showing terminals and a fusible body in the fuse according to the first embodiment of the invention.
Figure 3B:
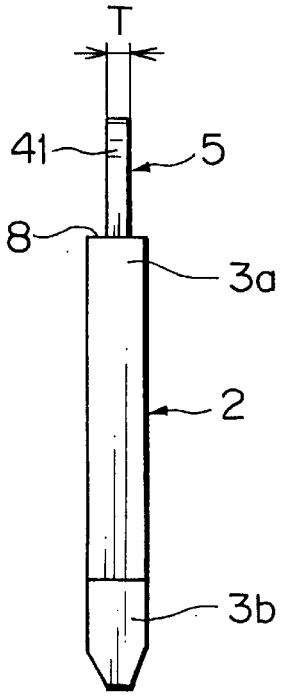
FIG. 3B is a sectional view showing the terminal and the fusible body viewed from the direction of an arrow IIIB in FIG. 3A.
Figure 4:
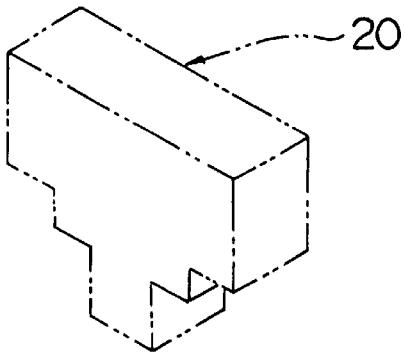
FIG. 4 is a perspective view of a housing chamber in the fuse according to the first embodiment of this invention.
Figure 8:
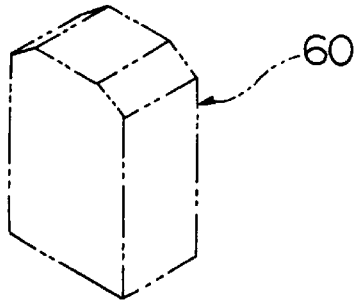
FIG. 8 PRIOR ART
FIG. 8 is a perspective view showing the space in the fuse shown in FIG. 6.

As seen from FIGS. 2 and 3A, the recess 6 is formed at the one end 3*a* of the terminal 2. The recess 6 is formed in concavity from the end face 27 (described later) of an inner protruding portion 26 in a direction the pair of terminals leave each other. The recesses 6 are formed so that the interval between the terminals 2 extend stepwise from the interval between the inner faces 9. The recess 6 includes a flat face 10 and a step face 11. The flat face 10 extends from the end face 8 located at the one end 3*a* of the terminal 2 to the central portion of the terminal 2 in its longitudinal direction. The step face 11 couples the flat face 10 and the inner face 9 with each other.

The flat faces 10 are formed so that the interval therebetween is wider than that between the inner faces 9 where the other ends 3*b* of the terminals 2 are located. The step faces 11 are formed in a direction of arranging the pair of terminals 2 in parallel. The recesses 6 are located within the housing 4 in a state where the terminals 2 have been attached to the housing 4.

The attaching holes 7 are formed so that they penetrate through the terminals 2. The attaching hole 7 is provided at the one end 3*a* of the terminal 2. The attaching hole 7 is provided closer than the recess to the central potion of the terminal 2. The attaching hole 7 is formed in square shape in section.

The inner protruding portion 26 is provided at the one end 3*a* of the terminal 2. The inner protruding portion 26 is provided closer than the recess to the central potion of the terminal 2. The inner protruding portions 26 are provided to protrude from the inner faces 9, respectively in a direction the pair of terminals approach each other. The inner protruding portions 26 have end faces opposite to each other. These end faces 27 are formed flatly in a longitudinal direction of the terminals. These inner protruding portions 26 are housed in the housing 4 when the one ends of the terminals 2 are housed in the housing 4.

When the fuse 1 is mounted in the electric connection box, the terminals 2 are electrically connected to receiving terminals of the box, respectively. One of the receiving terminals 2 is supplied with an electric power whereas the other thereof is electrically connected to various loads. Thus, the one of the terminal 2 is supplied with the electric power through the receiving terminal whereas the other thereof is connected to the loads.

The housing 4 is made of insulating synthetic resin. The housing 4 is formed in a box shape. The interior of the housing 54 constitutes a housing chamber within which the one ends of the above pair of terminals 52 are housed. As seen from FIG. 3, the housing 4 includes a pair of end walls 12*a*, 12*b*, a pair of side walls 13*a*, 13*b* and a pair of frame walls 14.

The pair of end walls 12*a*, 12*b* are opposite to each other in a direction crossing the direction of arranging the pair of terminals in parallel. When the terminals 2 are housed in the housing 4, the pair of end walls 12*b* are in parallel to the end face 8. The one wall 12*a* of the pair of end walls 12*a*, 12*b* is apart from and opposite to the end face 8 of each of the terminals 2.

The pair of end walls 12*a* and 12*b* are opposite to each other in a direction perpendicular to the direction of arranging the pair of terminals 2 in parallel. The pair of side walls 13*a*, 13*b* are opposite to each other in the direction of arranging the pair of terminals in parallel. The pair of side walls 13*a*, 13*b* are also formed in the longitudinal direction of the terminals 2.

The pair of frame walls 14 are opposite to each other in a direction crossing the direction of arranging the pair of terminals 2 to each other. The pair of frame walls 14 are communicated with both of the end walls 12*a*, 12*b* and side walls 13*a*, 13*b*, respectively. Incidentally, in FIG. 2, only the frame wall 14 in the inside is shown.

A space 20 (shown in FIGS. 2 and 4), which is surrounded by the respective inner faces 15*a*, 15*b* of the end walls 12*a*, 12*b*, respective inner faces 16*a*, 16*b* of the side walls 13*a*, 13*b* and respective inner faces 17 of the frame walls 14, constitutes a housing chamber for housing the one ends 3*a* of the terminals 2. Incidentally, the respective inner faces 15*a*, 15*b* of the pair of end walls 12*a*, 12*b* constitute first and second inner walls in the claims, respectively.

The end wall 12*b* which is located at the central portions of the terminals 2 includes a pair of through-holes 18 through which the terminals 2 are passed, respectively.

The housing 4 includes terminal position pins 23, a first partition wall 21 and a pair of second partition walls 22. The terminal positioning pins 23 are provided at a position in the vicinity of the side wall 13*a* and close to the end wall 12*b* and another position in the vicinity of the side wall 13*b* and close to the end wall 12*b*.

The terminal positioning pins 23 are provided to protrude from the inner face 17 of at least one of the frame walls 14 in a direction the pair of frame walls 14 approach each other. The terminal positioning pin 23 is adapted to invade the attaching hole 7 of the terminal 2.

In the configuration described above, the one ends 3*a* of the terminals 2 are housed in the housing chamber 20 in a state where the terminal positioning pins 23 of the housing 4 are passed through the attaching holes and located inside the side wall 13*a*, 13*b*.

The first partition wall 21 extends from the inner face 15*a* of the one end wall 12*a*, which is apart from opposite to the end faces 8, toward the inner face 15*b* of the other end wall 12*b*. The first partition wall 21 extends in the longitudinal direction of the side walls 13*a*, 13*b* and terminals 2.

The first partition wall 21 is formed at a central position between the terminals arranged in parallel. The first partition wall 21 extends to a central position between the pair of end walls 12*a*, 12*b*. In this way, the first partition wall 21 extends from one of the inner faces 15*a*, 15*b* from the other thereof.

The first partition wall 21 partitions the housing chamber 20 formed in the housing 4 into a first chamber 24 which houses the end 3*a* of one of the terminals 2 and a second chamber 25 which houses the end 3*a* of the other of the terminals 2. FIG. 2 shows the first chamber 24 located at the left side and the second chamber 25 located at the right side.

The second partition walls 22 extend from the inner face 15*b* of the end wall 12*b* toward the inner face 15*a* of the end wall 12*a*. The second partition walls 22 are formed at the edges of the exposing holes 19, respectively.

The second partition walls 22 are arranged in parallel in the direction of arranging the terminals 2 in parallel. The second partition walls 22 are arranged between the inner faces 16*a*, 16*b* of the side walls 13*a*, 13*b* and the first partition wall 21 in a direction of arranging the terminals 2 in parallel. The second partition walls 22 are bend so that the interval therebetween increases stepwise from the inner face 15*a* of the end face 12*a* to the inner face 15*b* of the end wall 12*b*.

The second partition walls 22 each consists of a first wall segment 33, a second wall segment 34 and third wall segment 35. The first wall segment 33 extends from the edge of the through-hole 18 of the end wall 12*b* toward the inner face 15*a* of the end wall 12*a* in the longitudinal direction of the terminal 2. The first wall segment 33 extends along the end face 27 of the inner protruding portion 26 of the terminal 2 and inner face 16*a*, 16*b*. The first wall segment 33 covers the end face 27 of the terminal 2 in the state where the one end 3*a* thereof is housed within the housing chamber 20.

The second wall segment 34 extends from the end of the first wall segment 33 located apart from the inner face 15*a* in a direction the terminals 2 leave each other. The second wall segment 34 extends along the step face 11 and the inner face 15*a*, 15*b*. The second wall segment 34 covers the step face 11 of the terminal 2 in the state where the one end 3*a* thereof is housed within the housing chamber 20.

The third wall segments 35 each extends from one of the ends of the second segment wall which is located more apart from each other toward the inner face 15*b* of the end wall 12*b* in the longitudinal direction of the terminal 2. The third wall segments 35 each extends along the flat face 10 of the recess 6 of the terminal 2 and inner face 16*a*, 16*b*. The third wall segments 35 each covers the flat face 10 of the terminal 2 in the state where the one end 3*a* thereof is housed within the housing chamber.

The third wall segment 35 is located at the center position between the inner face 16*a*, 16*b* of the side wall 13*a*, 13*b* and the first partition wall 21 in the direction of arranging the terminals 2 in parallel. The third segment 35 extends to the center between the pair of end walls 12*a* and 12*b* and hence their inner faces 15*a* and 15*b*.

A fusible body 5 couples the terminals 2 with each other. The fusible body 5 is formed linearly in square shape in section. The fusible body 5 is formed in such a size (width W, thickness T and length of L defined in FIGS. 3A and 3B) that it is fused when the supplied current exceeds a prescribed value.

The fusible body 5 couples the end faces 8 of the terminals 2 with each other. The fusible body 5 and the pair of terminals 2 can be obtained by rolling, cutting and stamping a certain material. Specifically, the fusible 5 and pair of terminals are integrally formed. As shown in FIGS. 2 and 3, the fusible body 5 consists of a pair of first extending segments 41, a pair of second extending segments 42, a pair of third extending segments 43 and a coupling segment 44.

The first extending segments 41 each extends from the corresponding end face 8 toward the inner face 15*b* of the end wall 12*b* in a direction leaving the pair of terminals 2. The first extending segments 41 each is provided at the center position between the inner face 16*a*, 16*b* of the side wall 13*a*, 13*b* and the third wall segment 35. The first extending segments 41 each extends along the side wall 13*a*, 13*b*, first and third wall segment 33, 35 and first partition wall 21.

The second extending segments 42 each extends from the end of the first extending segment 41 apart from the end face 8 in a direction they approach each other. The second extending segments 42 each is provided between the end of the third wall segment 35 and the inner face 15*b* of the end wall 12*b*. The second extending segments 42 each extends along the inner face 15*b* of the end wall 12*b* and the second wall segment 34.

The third extending segments 43 each extends from the one of ends of the second extending segment 42 which is located at the position is located nearer from each other toward the terminal 2 in a longitudinal direction of the terminal 2. The third extending segments 43 each is provided at the center position between the third wall segment 35 and the first partition wall 21 in the direction of arranging the terminals in parallel. The third extending segments 43 each extends along the first and the second wall segment 33, 35 and the inner faces 16*a* and 16*b* of the side walls 13*a* and 13*b*.

The coupling segment 44 couples the ends of the third extending segments 43 nearest to the terminals 2 each other. The coupling segment 44 is located between the end of the partition wall 21 and the second wall segments 34. The coupling segment 44 extends along the inner faces 15*a*, 15*b* of the end walls 12*a*, 12*b* and the second wall segments 34.

In this way, the fusible body 5 consists of the first to third extending segments 41, 42 and 43 and coupling segment 44 so that it bends from the coupling position with the one of the terminals to the coupling position with the other thereof.

In operation, where the fuse 1 having the above configuration is mounted in the electric connecting box, if the current value of the power supplied to one of the terminals 2 through the one receiving terminal exceeds the prescribed current value, the fusible body 5 fuses to stop the supply of the power to the load.

In the fuse 1 according to this embodiment, since the fusible body 5 is connected to the end faces 8 of the respective one ends 3 of the pair of terminals 2, the length L of the fusible body 5 can be lengthened. The interval D (shown in FIG. 3) between two positions where the fusible body 5 and terminals 2 are coupled can be increased.

Further, since the end faces 8 of the one ends 3 of the terminals 2 are located apart from the inner face 15*b* of the end wall 12*b*, the volume of the housing chamber 20 within the housing 4 can be increased. This assures a wide space where the fusible body 5 can fuse and scatter.

Therefore, the fused fusible body 5 becomes difficult to remain between the pair of terminals 2. In addition, after the fusible body 5 has fused, the fuse 1 can prevent the pair of the terminals 2 from being communicated with each other. Thus, when the power with a current value which exceeds the fusing current value of the fusible body is supplied, supply of the power to the load can be surely stopped.

Since the first partition wall 21 and the second partition walls 22 are located between the pair of terminals 2, deposition of the fused fusible body 5 onto the surface of each of the terminals 2 can be suppressed. Therefore, the fused fusible body 5 becomes further difficult to remain between the pair of terminals 2.

Therefore, after the fusible body 5 has fused, the fuse 1 can prevent the pair of the terminals 2 from being communicated with each other. Thus, when the power with a current value which exceeds the fusing current value of the fusible body is supplied, supply of the power to the load can be surely stopped.

Further, since the fusible body 5 is bent so as to consist of the first to third extending segments 41, 42 and 43 and coupling segment 44, its length L can be lengthened surely. The fusible body 5 is bent and the first partition wall 21 and second partition walls 22 are extended to the central position between the end walls 12*a*, 12*b* in a direction they are opposite opposite to each other. Further, the first extending segments 41 and the third extending segments 43 are formed along the first partition wall 21 whereas the second extending segments 42 and the coupling segment 44 are formed along the inner face 15*a* of the end wall 12*a*.

For this reason, the fused fusible body 5 is easily deposited onto the surfaces of the first partition wall 21 and the second partition walls 22 and the inner face 15*a*. As a result, the fused fusible body 5 is further difficult to remain between the pair of terminals 2. Therefore, after the fusible body 5 has fused, the fuse 1 can prevent the pair of the terminals 2 from being communicated with each other. Thus, when the power with a current value which exceeds the fusing current value of the fusible body is supplied, supply of the power to the load can be more surely stopped.

Figure 5:
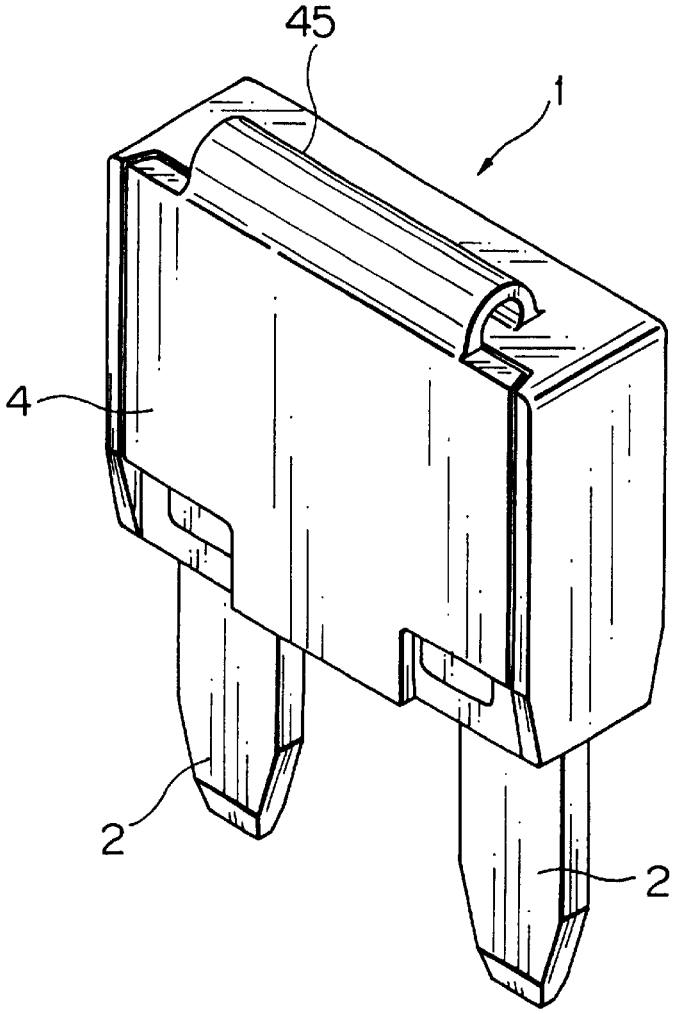
FIG. 5 is a perspective view of a modification of the fuse according to this invention.
Figure 7:
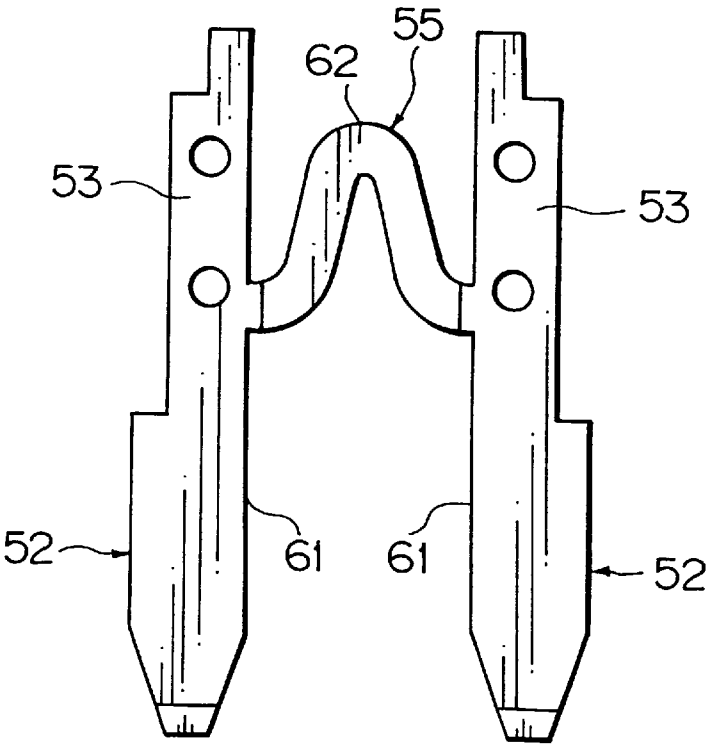
FIG. 7 PRIOR ART
FIG. 7 is a sectional view of the terminals and fusible body in the fuse shown in FIG. 6.
Figure 6:
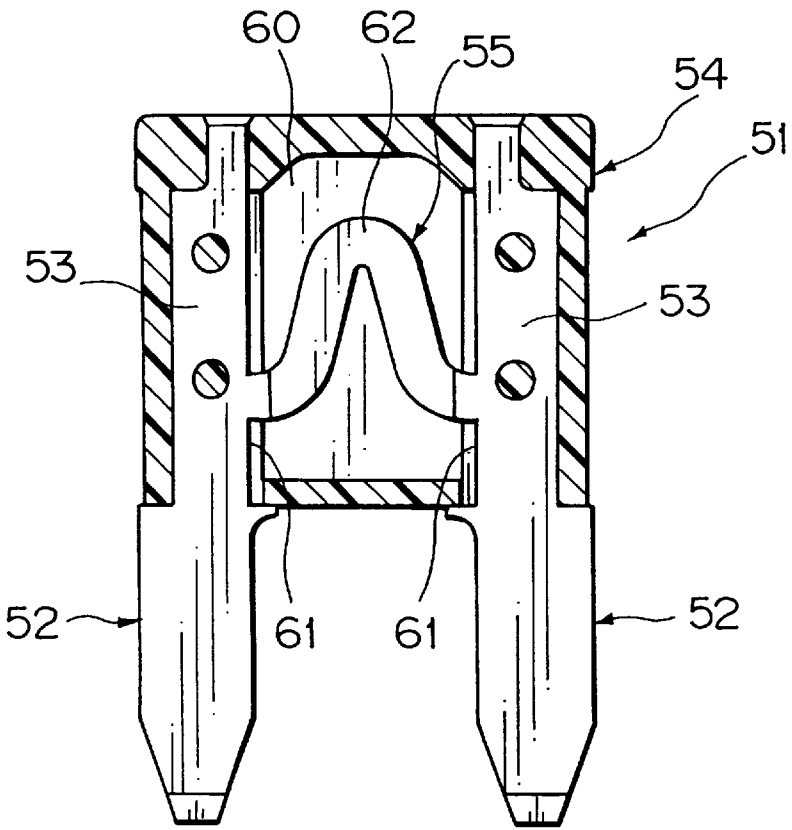
FIG. 6 PRIOR ART
FIG. 6 is a sectional view of the structure of a conventional fuse.

The housing 4 of the fuse 1 according to the embodiment described above may be provided with knob 45 as shown in FIG. 5. The knob 45 is formed to protrude outwardly from the edge of the housing 4. By picking up the knob 45, the fuse 1 can be removed from a junction block, relay box or fuse block.

What is claimed is:

1. A fuse including a pair of terminals arranged in parallel, a housing including a housing chamber housing respective one ends of the terminals, the one ends comprising respective end faces, and a fusible body coupling said end faces of said pair of terminals with each other, wherein said fusible body is connected to said respective end faces of said pair of terminals; and wherein each of the end faces substantially surrounds the fusible body, whereby a cross-sectional area of the fusible body is substantially reduced relative to that of the terminals.

2. A fuse including a pair of terminals arranged in parallel, a housing including a housing chamber housing respective one ends of the terminals, and a fusible body coupling the one ends of the pair of terminals with each other;

wherein said housing comprises a first inner wall which is opposite to the respective one ends of said pair of terminals and constitutes said housing chamber, and wherein said inner wall comprises a first partition wall which extends from said first inner wall and is located between said pair of terminals in a direction they are arranged in parallel;

whereby short-circuiting is avoided when the fusible body scatters with high momentum.

3. A fuse including a pair of terminals arranged in parallel, a housing including a housing chamber housing respective one ends thereof and a fusible body coupling said pair of terminals with each other, wherein said fusible body is connected to respective end faces of said one ends of said pair of terminals;

a second inner wall opposite to said first inner wall;

a first partition wall which extends from said first inner wall toward the said second inner wall and is located between said plurality of terminals in a direction they are arranged in parallel; and a plurality of second partition walls which extend from said second inner wall toward said first inner wall and are located between said first partition wall and said pair of terminals, respectively.

4. A fuse according to claim 3, wherein said fusible body is bent to include: a pair of first extending segments which extend from said pair of terminals in a direction leaving therefrom, respectively; a pair of second extending segments which extend from ends of said first extending segments in a direction said pair of terminals approach each other; a pair of third extending segments which extend from ends of said second extending elements in a direction approaching said pair of terminals; and a coupling segment which couples said pair of third extending segments.

5. A fuse according to claim 4, wherein said first pair of and third pair of extending segments are formed along said first partition wall, and said second pair of extending segments and said coupling segment are formed along said first inner wall.

* * * * *